US008803859B2

(12) United States Patent
Cho et al.

(10) Patent No.: US 8,803,859 B2
(45) Date of Patent: Aug. 12, 2014

(54) DISPLAY DRIVING CIRCUIT HAVING HALF VDD POWER SUPPLY CIRCUIT BUILT THEREIN AND DISPLAY DRIVING SYSTEM INCLUDING THE SAME

(75) Inventors: Hyun Ho Cho, Incheon-si (KR); Yong Bok Kim, Busan-si (KR); Pyung Sik Ma, Daejeon-si (KR); An Young Kim, Daejeon-si (KR); Yong Icc Jung, Incheon-si (KR); Joon Ho Na, Daejeon-si (KR)

(73) Assignee: Silicon Works Co., Ltd., Daejeon-Si (KR)

( * ) Notice: Subject to any disclaimer, the term of this patent is extended or adjusted under 35 U.S.C. 154(b) by 373 days.

(21) Appl. No.: 13/331,706

(22) Filed: Dec. 20, 2011

(65) Prior Publication Data

US 2012/0161661 A1 Jun. 28, 2012

(30) Foreign Application Priority Data

Dec. 27, 2010 (KR) ..... 10-2010-0135719

(51) Int. Cl.
*G09G 3/00* (2006.01)
*G09G 3/36* (2006.01)

(52) U.S. Cl.
CPC ..... *G09G 3/3696* (2013.01); *G09G 2330/02* (2013.01)
USPC ..... 345/204; 345/211; 315/175

(58) Field of Classification Search
CPC . G09G 5/00; G09G 2330/00; G09G 2330/02; G09G 2330/021; G09G 3/00; G09G 3/3696
USPC ..... 345/211, 204, 212, 214, 205; 315/169.1, 169.2, 169.3, 160, 175, 315/174, 176
See application file for complete search history.

(56) References Cited

U.S. PATENT DOCUMENTS

2009/0040165 A1* 2/2009 Shimatani ..... 345/98
2009/0219270 A1* 9/2009 Penev et al. ..... 345/211

FOREIGN PATENT DOCUMENTS

KR 10-2007-0069408 7/2007

* cited by examiner

*Primary Examiner* — David H Vu
(74) *Attorney, Agent, or Firm* — Kile Park Reed & Houtteman PLLC

(57) ABSTRACT

The present invention relates to a display driving circuit and a display driving system, and more particularly, to a display driving circuit having a half-VDD power supply circuit built therein and a display driving system including the same, in which the display driving circuit is further provided with a half voltage VDD terminal in addition to the highest voltage VDD terminal and the lowest voltage VSS terminal, and the half voltage, which is between the highest voltage and the lowest voltage, is generated and supplied by the half voltage power supply from the inside of the display driving circuit, rather than being supplied from an external power supply.

22 Claims, 3 Drawing Sheets

DISPLAY DRIVING CIRCUIT HAVING HALF VDD POWER SUPPLY CIRCUIT BUILT THEREIN AND DISPLAY DRIVING SYSTEM INCLUDING THE SAME

BACKGROUND OF THE INVENTION

1. Field of the Invention

The present invention relates to a display driving circuit and a display driving system, and more particularly, to a display driving circuit having a half-VDD power supply circuit built therein and a display driving system including the same, in which the display driving circuit is further provided with a half voltage VDD terminal in addition to the highest voltage VDD terminal and the lowest voltage VSS terminal, and the half voltage, which is between the highest voltage and the lowest voltage, is generated and supplied by the half voltage power supply from the inside of the display driving circuit, rather than being supplied from an external power supply.

2. Description of the Related Art

A liquid crystal display is a device on which image data is displayed by passing light into a liquid crystal using the phenomenon by which the arrangement of the liquid crystal molecules varies depending on the applied voltage.

In the display driving circuit and system for driving the liquid crystal display, when current consumption, which is one of the most important factors, is increased, the temperature of the display driving circuit and system increases, and accordingly, the reliability and service life of the circuit and system can be degraded and shortened due to the increased temperature.

Thus, in the display driving circuit of the related art, an output buffer of the display driving circuit is further provided with a terminal of a half voltage VDD, which has a half voltage level between a first voltage VDD and a second voltage VSS, in addition to the first voltage VDD, having the highest voltage level, and the second voltage VSS, having the lowest voltage level, thereby reducing current consumption.

FIG. 1 is a block diagram illustrating the configuration of a display driving circuit in accordance with the related art, and FIG. 2 is a view illustrating a half voltage supplied from outside the display driving circuit of the related art.

Referring FIG. 1, the display driving circuit 100 includes a first buffer 110, a second buffer 120, a first switch 130 and a second switch 140.

The first buffer 110 is a buffer for driving a positive voltage level of a display panel, and includes a terminal of a first voltage VDD, having a high voltage level, a terminal of a second VSS, having a low voltage level, and a terminal of a half voltage H-VDD, having a half voltage level. In this case, the terminal of the half voltage H-VDD is connected to a discharging path of the first buffer 110.

The second buffer 220 is a buffer for driving a negative voltage level of the display panel, and includes a terminal of a first voltage VDD having a high voltage level, a terminal of a second voltage VSS, having a low voltage level, and a terminal of a half voltage H-VDD, having a half voltage level. In this case, the terminal of the half voltage H-VDD is connected to a charging path of the second buffer 120.

In addition, the half voltage HDD has a voltage level within a range between the first voltage VDD and the second voltage VSS, and allows the first and second buffers 110 and 120 to be operated.

Meanwhile, the first switch 130 is a switch for delivering input signals Even_input and Odd_input to the first and second buffers 110 and 120, and may be used for polarity inversion to prevent the phenomenon of adhesion of the liquid crystal display panel.

In addition, the second switch 140 is a switch for delivering output signals Even_output and Odd_output of the first and second buffers 110 and 120 to data lines of the liquid crystal display, and may also be used for polarity inversion to prevent the phenomenon of adhesion of the liquid crystal display panel.

As shown in FIG. 1, the buffers I10 and 120 according to the related art include the terminal of the first voltage VDD for operating voltage, the terminal of the second voltage VSS and the terminal of the half voltage H-VDD, that is, three terminals. Meanwhile, as shown in FIG. 2, when the display driving circuit of the related art is implemented, the first and second voltages VDD and VSS and the half voltage H-VDD are supplied from a power supply circuit on the outside of the driving circuit.

Thus, in the display driving circuit of the related art, since an additional power supply circuit for supplying the half voltage H-VDD must be provided on the outside of the display driving circuit, in addition to a supply circuit for supplying the first and second voltages VDD and VSS, there is a problem in that miniaturization of the system is difficult and production costs are increased.

SUMMARY OF THE INVENTION

Accordingly, the present invention has been made in an effort to solve the problem occurring in the related art, and an object of the present invention is to provide a display driving circuit having a half-VDD power supply circuit built therein, in which a half voltage H-VDD, which is required for the operation of a buffer, can be generated and supplied from inside the display driving circuit, obviating the requirement for a separate power supply circuit on the outside of the display driving circuit.

In order to achieve the above object, according to one aspect of the present invention, there is provided a display driving circuit including: a first buffer, which includes a terminal of a first voltage VDD having the highest voltage, a terminal of a second voltage VSS having the lowest voltage, and a terminal of a half voltage H-VDD, which is driven within a range between the first voltage VDD and the half voltage H-VDD; a second buffer, which includes the terminal of the first voltage VDD, the terminal of the second voltage VSS and the terminal of the half voltage H-VDD, which is driven within a range between the half voltage H-VDD and the second voltage VSS; and a half voltage power supply circuit, which supplies half voltage power to the first buffer and the second buffer, wherein the first voltage VDD and the second voltage VSS are supplied from a power supply circuit on the outside of the display driving circuit and the half voltage H-VDD is supplied from a half voltage power supply circuit on the inside of the display driving circuit.

In addition, according to another aspect of the present invention, there is provided a display driving system including: a display panel; a plurality of display driving circuits for driving the display panel; and a printed circuit board, on which a power supply circuit for supplying power to the display driving circuit is formed, wherein the display driving circuit includes: a first buffer, which includes a terminal of a first voltage VDD having the highest voltage, a terminal of a second voltage VSS having the lowest voltage, and a terminal of a half voltage H-VDD, which is driven within a range between the first voltage VDD and the half voltage H-VDD, a second buffer, which includes the terminal of the first voltage VDD, the terminal of the second voltage VSS, and the terminal of the half voltage H-VDD, which is driven within a range between the half voltage H-VDD and the second voltage VSS; a half voltage power supply circuit, which supplies half voltage power to the first buffer and the second buffer, the first voltage VDD and the second voltage VSS being supplied from a power supply circuit on the outside of the display driving circuit, and the half voltage H-VDD being supplied from the half voltage power supply circuit on the inside of the display driving circuit.

BRIEF DESCRIPTION OF THE DRAWINGS

The above objects, and other features and advantages of the present invention will become more apparent after a reading of the following detailed description taken in conjunction with the drawings, in which.

DETAILED DESCRIPTION OF PREFERRED EMBODIMENTS

Figure 1:
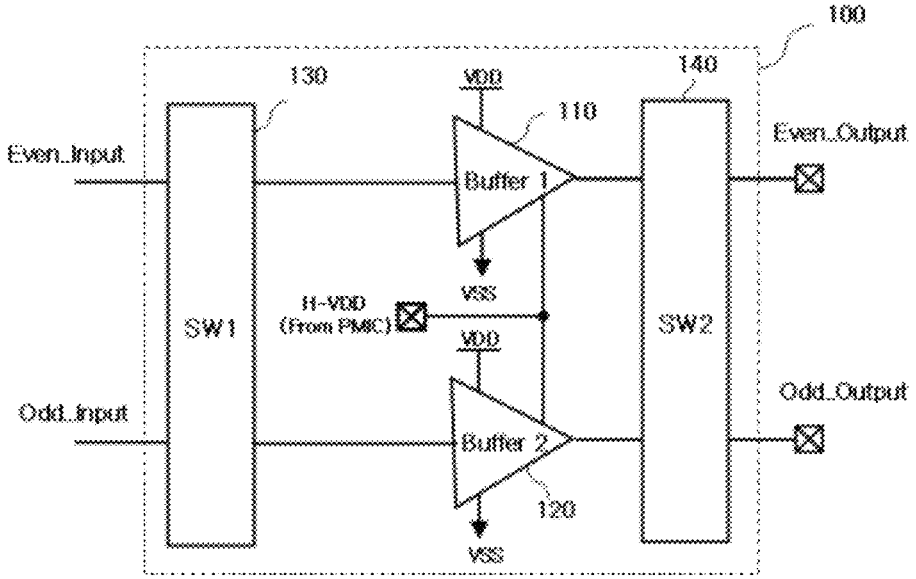
Fig. 1 (Prior Art)
FIG. 1 is a block diagram showing the configuration of a display driving circuit of the related art.
Figure 2:
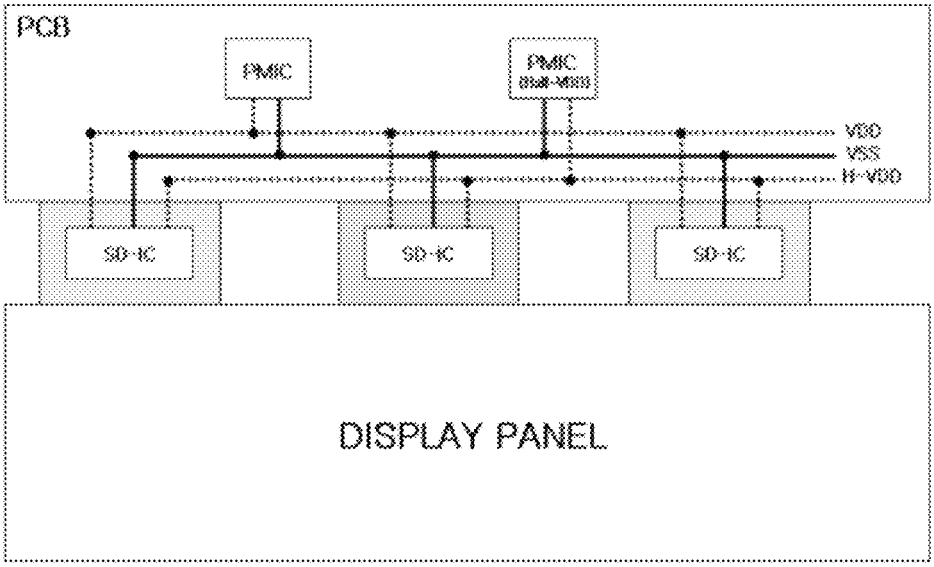
Fig. 2 (Prior Art)
FIG. 2 is a view illustrating a half voltage supplied from the outside of a display driving circuit of the related art.

Reference will now be made in greater detail to a preferred embodiment of the invention, an example of which is illustrated in the accompanying drawings. Wherever possible, the same reference numerals will be used throughout the drawings and the description to refer to the same or like parts.

Figure 3:
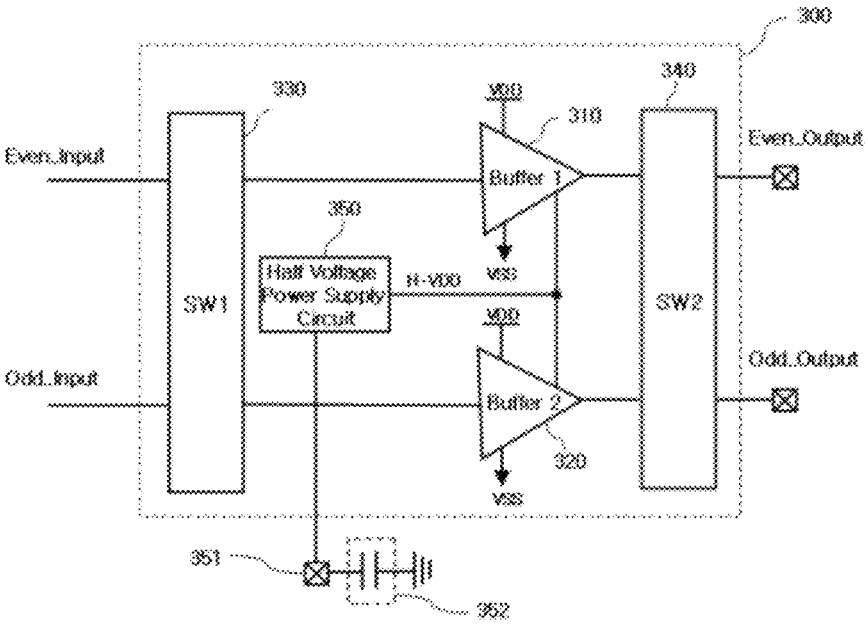
FIG. 3 is a block diagram showing a configuration of a display driving circuit having a half-voltage VDD power supply circuit built therein in accordance with the present invention.
Figure 4:
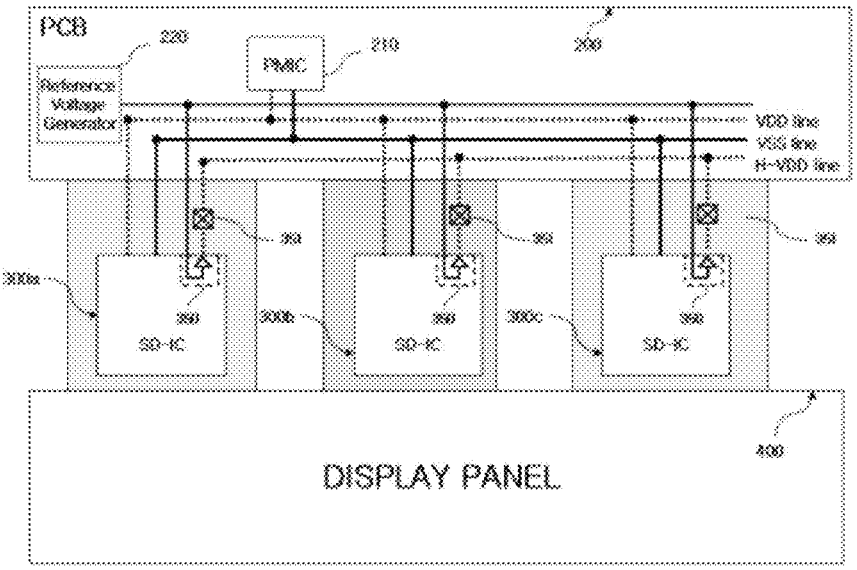
FIG. 4 is a view schematically illustrating an embodiment of a display driving circuit having a half-voltage VDD power supply circuit built therein and a display driving system including the same.

FIG. 3 is a block diagram showing the configuration of a display driving circuit having a half-voltage VDD power supply circuit built therein in accordance with the present invention, and FIG. 4 is a view schematically illustrating an embodiment of the display driving circuit having the half-voltage VDD power supply circuit built therein, and a display driving system including the same.

Figure 5:
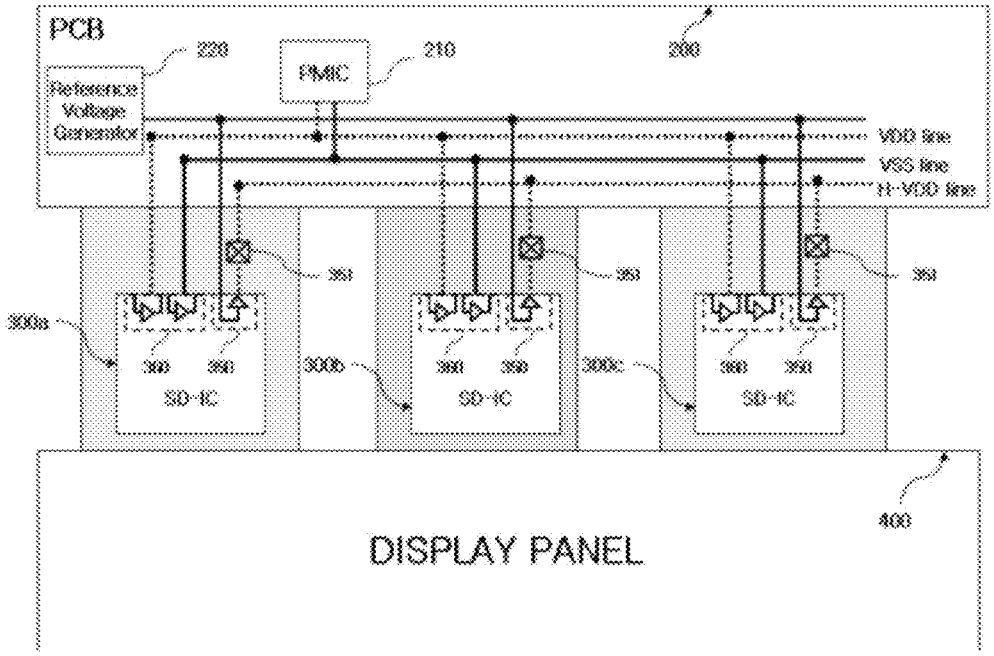
FIG. 5 is a view schematically illustrating another embodiment of a display driving circuit having a half-voltage VDD power supply circuit built therein and a display driving system including the same.
Figure 6:
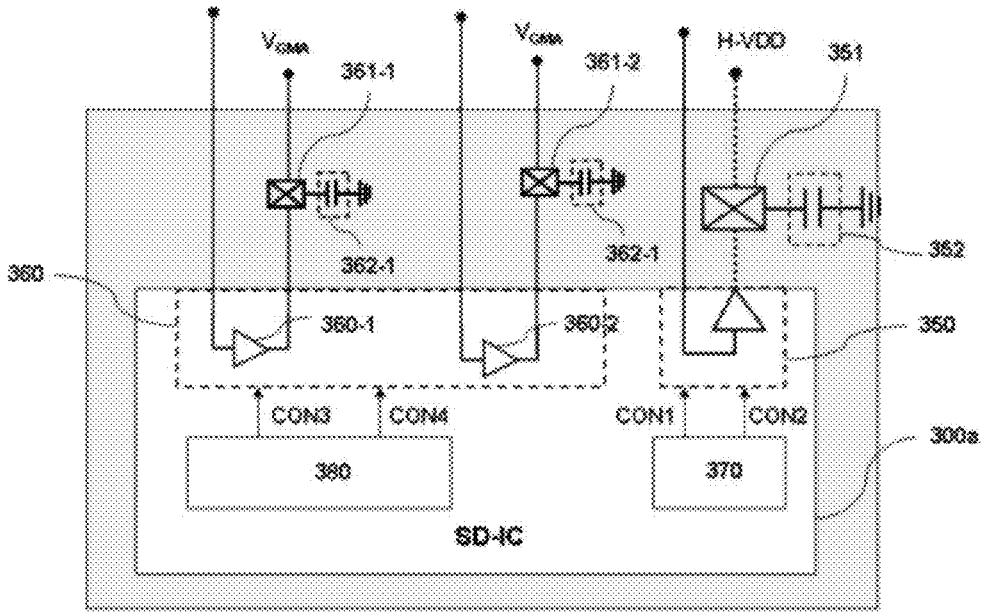
FIG. 6 is an exploded view illustrating a portion of FIG. 5 in detail.

In addition, FIG. 5 is a view schematically illustrating another embodiment of a display driving circuit having a half-voltage VDD power supply circuit built therein and a display driving system including the same, and FIG. 6 is an exploded view illustrating a portion of FIG. 5 in detail.

As shown in FIGS. 3 to 6, the display driving circuit 300 according to the present invention includes a first buffer 310, a second buffer 320, a first switch 330, a second switch 340 and a half voltage power supply circuit 350.

The first buffer 310 includes a terminal of a first voltage VDD, having the highest voltage, a terminal of a second voltage VSS, having the lowest voltage, and a terminal of a half voltage H-VDD, which is driven within a range between the first voltage VDD and the half voltage H-VDD.

The second buffer 320 includes the terminal of the first voltage VDD, the terminal of the second voltage VSS and the terminal of the half voltage H-VDD, which is driven within a range between the half voltage H-VDD and the second voltage VSS.

The first switch 330 is a switch for delivering input signals Even_input and Odd_input to the first and second buffers 310 and 320, and may be used for polarity inversion to prevent the phenomenon of adhesion of a liquid crystal display panel.

In addition, the second switch 340 is a switch for delivering output signals Even_output and Odd_output of the first and second buffers 310 and 320 to a data line of the liquid crystal display, and may also be used for polarity inversion to prevent the phenomenon of adhesion of the liquid crystal display panel.

The half voltage power supply circuit 350 supplies half voltage power H-VDD to the first buffer 310 and the second buffer 320.

In this case, the first voltage VDD and the second voltage VSS are supplied from a power supply circuit 210 on the outside of the display driving circuit 300, and the half voltage H-VDD is supplied from a half voltage power supply circuit 350 on the inside of the display driving circuit 300.

Meanwhile, the half voltage power supply circuit 350 receives and buffers a voltage having the half voltage level from a reference voltage generator 220 formed on a printed circuit board 200 on the outside of the display driving circuit 300 to supply half voltage power.

In order to stabilize the half voltage, a terminal of the half voltage power supply circuit 350 is preferably provided with a half voltage output pad 351 and a half voltage stabilizing capacitor 352. That is, the terminal of the half voltage power supply circuit 350 is provided with the half voltage output pad 351 for outputting the half voltage H-VDD, which is generated from the half voltage power supply circuit 350, to the outside of the display driving circuit 300, and the half voltage output pad 351 is connected to the half voltage stabilizing capacitor 352, thereby stabilizing the half voltage.

Meanwhile, the display driving circuit 300 in accordance with the present invention may separately include a control unit 370 for controlling the half voltage power supply circuit 350, and then may use the half voltage supplied from the outside, if necessary, without operating the half voltage power supply circuit 350.

That is, if a first control signal CON1, generated from the control unit 370 for controlling the half voltage power supply circuit 350, is enabled, the half voltage power supply circuit 350 can be operated, and then the half voltage is generated and supplied to the inside of the display driving circuit 300. Accordingly, the generated half voltage can be supplied to the first buffer 310 and the second buffer 320. Meanwhile, if the first control signal CON1 is disabled, the display driving circuit 300 can be operated by the half voltage supplied from the outside, without operating the half voltage power supply circuit 350.

In addition, the control unit 370 for controlling the half voltage power supply circuit 350 can separately generate a second control signal CON2 to adjust the driving current of the half voltage power supply circuit 350.

Meanwhile, according to the present invention, the display driving circuit 300 having the half voltage VDD power supply circuit built therein may further include a gamma reference voltage buffer 360, which is included in the inside of the display driving circuit 300, to supply a gamma reference voltage VGMA.

In this case, the gamma reference voltage buffer 360 receives and buffers a voltage having a gamma reference voltage VGMA level from the outside to then generate and supply a gamma reference voltage VGMA.

In order to stabilize the gamma reference voltage VGMA, output terminals of the gamma reference voltage buffer 360 are preferably provided with gamma reference voltage output pads 361-1 and 361-2 and gamma reference voltage stabilizing capacitors 362-1 and 362-2. That is, output terminals of the gamma reference voltage buffer 360 are provided with the gamma reference voltage output pads 361-1 and 361-2 for outputting the gamma reference voltage VGMA generated from the gamma reference voltage buffer 360 to the outside of the display driving circuit 300, and the gamma reference voltage output pads 361-1 and 361-2 are connected to the gamma reference voltage stabilizing capacitor 362-1 and 361-2, thereby stabilizing the gamma reference voltage.

Meanwhile, the display driving circuit 300 in accordance with the present invention may separately include a gamma reference voltage buffer control unit 380 for controlling the gamma reference voltage buffer 360, and then may use the half voltage supplied from the outside, if necessary, without operating the gamma reference voltage buffer 360.

That is, if a third control signal CON3 generated from the gamma reference voltage buffer control unit 380 for controlling the gamma reference voltage buffer 360 is enabled, the gamma reference voltage buffer 360 can be operated, and then the gamma reference voltage VGMA is buffered inside the display driving circuit 300 to supply the same to the first buffer 310 and the second buffer 320. Meanwhile, if the third control signal CON3 is disabled, the display driving circuit 300 can be operated by the gamma reference voltage VGMA supplied from the outside, without operating the gamma reference voltage buffer 360.

In addition, the gamma reference voltage buffer control unit 380 for controlling the gamma reference voltage buffer 360 can generate a separate fourth control signal CON4 to adjust the driving current of the gamma reference voltage buffer 360.

The display driving circuit of the present invention may be configured to include a plurality of gamma reference voltage buffers, that is, at least one or more positive gamma reference voltage buffers and at least one or more negative gamma reference voltage buffers.

The display driving system according to the present invention includes a display panel 400, a plurality of display driving circuits 300 for driving the display panel, and a printed circuit board 200, on which a power supply circuit for supplying power to the display driving circuit is formed.

In this case, the display driving circuit 300 includes a first buffer 310, a second buffer 320, a first switch 330, a second switch 340, and a half voltage power supply circuit 350.

The first voltage VDD and the second voltage VSS are supplied from a power supply circuit 210 on the outside of the display driving circuit 300, and the half voltage H-VDD is supplied from a half voltage power supply circuit 350 on the inside of the display driving circuit 300. In addition, respective outputs of the half voltage power supply circuits 350 in the plurality of display driving circuits 300 are connected to one anther via a common line H-VDD line formed on the printed circuit board 200.

In the display driving system according to the present invention, the display driving circuit has already been described above, and an overlapping detailed description of the display driving circuit is omitted.

In the plurality of display driving circuits 300*a*, 300*b*, 300*c*, the half voltage power supply circuit 350 of at least one display driving circuit (for example, 300*a*) receives and buffers voltage having a half voltage level to thus generate and output half voltage power through a half voltage output pad 351.

The half voltage power outputted through the half voltage output pad 351 is supplied to the half voltage output pad 351 of the remaining display driving circuits (for example, 300*b* and 300*c*) through the common line H-VDD line.

Meanwhile, the half voltage power supply circuit 350 may receive and buffer a voltage having a common half voltage level from the outside to generate and output half voltage power through each half voltage output pad 351.

If the half voltage output pad 351 is provided with a half voltage stabilizing capacitor 352, the half voltage power can be stabilized.

In the present invention, the display driving system may include a plurality of display driving circuits, and the display driving circuits may include a separate half voltage power supply circuit. In addition, each output of the half voltage power supply circuits may be connected to a common line formed on the printed circuit board through each half voltage output pad.

In the operation of the display driving system according to the present invention, all the half voltage power supply circuits may be used, but alternatively, only one or two the half voltage power supply circuits may be used, if necessary.

Thus, even when only the half voltage supply circuit of any one display driving circuit is used, since the outputs of each half voltage power supply circuit are connected in common through the common line H-VDD line, the half voltage can be also supplied to other display driving circuits.

As is apparent from the above description, the present invention provides a display driving circuit having the half-VDD power supply circuit built therein, in which the half voltage H-VDD of the display driving circuit can be generated and supplied from the inside of the display driving circuit. Therefore, since the display driving circuit does not need a separate power supply circuit (that is, a power management IC) for generating the half voltage, the present invention has an advantage in that the size of the display driving circuit can be reduced, thereby saving production costs.

Although a preferred embodiment of the present invention has been described for illustrative purposes, those skilled in the art will appreciate that various modifications, additions and substitutions are possible, without departing from the scope and the spirit of the invention as disclosed in the accompanying claims.

What is claimed is:

1. A display driving circuit, comprising:

a first buffer, which includes a terminal of a first voltage VDD having a highest voltage, a terminal of a second voltage VSS having a lowest voltage, and a terminal of a half voltage H-VDD, which is driven within a range between the first voltage VDD and the half voltage H-VDD;

a second buffer, which includes the terminal of the first voltage VDD, the terminal of the second voltage VSS, and the terminal of the half voltage H-VDD, which is driven within a range between the half voltage H-VDD and the second voltage VSS; and a half voltage power supply circuit, which supplies the half voltage power to the first buffer and the second buffer, wherein the first voltage VDD and the second voltage VSS are supplied from a power supply circuit on an outside of the display driving circuit, and the half voltage H-VDD is supplied from the half voltage power supply circuit on an inside of the display driving circuit.

2. The display driving circuit according to claim 1, wherein the half voltage power supply circuit receives and buffers a voltage having a half voltage level from a reference voltage generator on the outside of the display driving circuit to supply a half voltage power.

3. The display driving circuit according to claim 1, further comprising:

a half voltage output pad, which outputs the half voltage generated from the half voltage power supply circuit to the outside of the display driving circuit; and a half voltage stabilizing capacitor, a first terminal of which is connected to the half voltage output pad and a second terminal of which is grounded.

4. The display driving circuit according to claim 1, further comprising:

a half voltage power supply circuit control unit that controls operation and driving current of the half voltage power supply circuit.

5. The display driving circuit according to claim 1, further comprising:

a gamma reference voltage buffer, which is included in the inside of the display driving circuit to supply a gamma reference voltage VGMA to the first buffer and the second buffer.

6. The display driving circuit according to claim 5, wherein the gamma reference voltage buffer receives and buffers a voltage having the half voltage level from the outside of the display driving circuit to generate a gamma reference voltage.

7. The display driving circuit according to claim 5, further comprising:

a gamma reference voltage output pad that outputs the gamma reference voltage generated from the gamma reference voltage buffer to the outside of the display driving circuit; and a gamma reference voltage stabilizing capacitor, a first terminal of which is connected to the gamma reference voltage output pad, and a second terminal of which is grounded.

8. The display driving circuit according to claim 5, further comprising:

a gamma reference voltage buffer control unit, which controls operation and driving current of the gamma reference voltage buffer.

9. The display driving circuit according to claim 5, wherein the gamma reference voltage buffer includes at least one positive gamma reference voltage buffer and at least one negative gamma reference voltage buffer.

10. A display driving system comprising:

a display panel;

a plurality of display driving circuits for driving the display panel; and a printed circuit board, on which a power supply circuit for supplying power to the display driving circuit is formed, wherein the display driving circuit includes:

a first buffer, which includes a terminal of a first voltage VDD, having a highest voltage, a terminal of a second voltage VSS, having a lowest voltage, and a terminal of a half voltage H-VDD, which is driven within a range between the first voltage VDD and the half voltage H-VDD;

a second buffer, which includes the terminal of the first voltage VDD, the terminal of the second voltage VSS and the terminal of the half voltage H-VDD for driving within a range between the half voltage H-VDD and the second voltage VSS; and a half voltage power supply circuit, which supplies the half voltage power to the first buffer and the second buffer, wherein:

the first voltage VDD and the second voltage VSS are supplied from a power supply circuit on an outside of the display driving circuit, and the half voltage H-VDD is supplied from the half voltage power supply circuit on an inside of the display driving circuit, and respective output of the half voltage power supply circuits provided on the plurality of display driving circuits are connected to one another via a common line formed on the printed circuit board.

11. The display driving system according to claim 10, wherein the half voltage power supply circuit in at least one display driving circuit in the plurality of display driving circuits receives and buffers voltage having a half voltage level to generate and output a half voltage through a half voltage output pad, and wherein the half voltage outputted through the half voltage output pad is supplied to the half voltage power supply circuits in remaining display driving circuits through the common line.

12. The display driving system according to claim 11, wherein the half voltage power supply circuit in the plurality of display driving circuits receives and buffers a voltage having a common half voltage level from the outside to generate and output a half voltage through each half voltage output pad.

13. The display driving system according to claim 11, wherein the half voltage power supply circuit in the plurality of display driving circuits further includes a half voltage stabilizing capacitor, a first terminal of which is connected to the half voltage output pad and a second terminal of which is grounded.

14. The display driving system according to claim 11, wherein the half voltage power supply circuit in the plurality of display driving circuits further includes a half voltage stabilizing capacitor, a first terminal of which is connected to the common line and a second terminal of which is grounded.

15. The display driving system according to claim 10, further comprising:

a half voltage power supply circuit control unit, which controls operation and driving current of the half voltage power supply circuit.

16. The display driving circuit according to claim 2, further comprising:

a half voltage output pad, which outputs the half voltage generated from the half voltage power supply circuit to the outside of the display driving circuit; and a half voltage stabilizing capacitor, a first terminal of which is connected to the half voltage output pad and a second terminal of which is grounded.

17. The display driving circuit according to claim 2, further comprising:

a half voltage power supply circuit control unit, which controls operation and driving current of the half voltage power supply circuit.

18. The display driving circuit according to claim 6, further comprising:

a gamma reference voltage output pad, which outputs the gamma reference voltage generated from the gamma reference voltage buffer to the outside of the display driving circuit; and a gamma reference voltage stabilizing capacitor, a first terminal of which is connected to the gamma reference voltage output pad and a second terminal of which is grounded.

19. The display driving circuit according to claim 6, further comprising:

a gamma reference voltage buffer control unit which controls operation and driving current of the gamma reference voltage buffer.

20. The display driving circuit according to claim 6, wherein the gamma reference voltage buffer includes at least one positive gamma reference voltage buffer and at least one negative gamma reference voltage buffer.

21. The display driving system according to claim 12, wherein the half voltage power supply circuit in the plurality of display driving circuits further includes a half voltage stabilizing capacitor, a first terminal of which is connected to the half voltage output pad and a second terminal of which is grounded.

22. The display driving system according to claim 12, wherein the half voltage power supply circuit in the plurality of display driving circuits further includes a half voltage stabilizing capacitor, a first terminal of which is connected to the common line and a second terminal of which is grounded.

* * * * *